US007989723B2

(12) United States Patent
Wang et al.

(10) Patent No.: US 7,989,723 B2
(45) Date of Patent: Aug. 2, 2011

(54) BUTTON APPARATUS WITH AUTOMATIC RESET FUNCTION

(75) Inventors: Tsung-Chin Wang, Taipei Hsien (TW); Feng-Yang Ma, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 541 days.

(21) Appl. No.: 12/166,333

(22) Filed: Jul. 2, 2008

(65) Prior Publication Data

US 2009/0050463 A1 Feb. 26, 2009

(30) Foreign Application Priority Data

Aug. 24, 2007 (CN) ..... 2007 1 0201464

(51) Int. Cl.
*H01H 13/02* (2006.01)

(52) U.S. Cl. ..... 200/339; 200/6 R

(58) Field of Classification Search ..... 200/5 A, 200/6 R, 329, 339–341, 510, 553, 557
See application file for complete search history.

(56) References Cited

U.S. PATENT DOCUMENTS

| | | | | |
|---|---|---|---|---|
| 7,217,898 | B2 * | 5/2007 | Chien et al. | 200/339 |
| 7,521,643 | B2 * | 4/2009 | Liu | 200/500 |
| 2004/0040826 | A1 | 3/2004 | Kitagawa | |

FOREIGN PATENT DOCUMENTS

| | | | |
|---|---|---|---|
| CN | 200520064974.2 | | 11/2006 |
| JP | 4179014 | A | 6/1992 |
| JP | 200322732 | A | 1/2003 |
| JP | 2005203190 | A | 7/2005 |
| TW | I253664 | A | 4/2006 |

* cited by examiner

*Primary Examiner* — Renee Luebke
*Assistant Examiner* — Marina Fishman
(74) *Attorney, Agent, or Firm* — Zhigang Ma

(57) ABSTRACT

A button apparatus includes a button, a cover pivotally engaged with the button, and a chassis secured to the cover. The chassis includes a frame, an opening defined in the frame, and an elastic element connected between two opposite sides of the frame. The elastic element includes a first contact portion and a second contact portion. The button includes two pressing portions extending outwardly from two opposite sides thereof. The two pressing portions are arranged at two opposite sides of the elastic element. When the button is depressed, it moves relative to the cover from an original position to a depressed position, causing one of the first and second contact portions to be resiliently distorted and abut one of the two opposite sides of the body. When the button is released, the elastic element restores the button to the original position.

18 Claims, 5 Drawing Sheets

BUTTON APPARATUS WITH AUTOMATIC RESET FUNCTION

BACKGROUND

1. Field of the Invention

The present invention relates to a button apparatus, and more particularly to a button apparatus with automatic reset function, applicable in a portable electronic device such as a digital camera.

2. Description of Related Art

Electronic devices, such as digital cameras and digital video cameras, are becoming widely used. In a typical camera module, a button apparatus is often provided to activate functions of the camera such as auto-focus and image capture. The button apparatus conventionally includes a button, a cover, and a chassis secured to the cover. The button includes a first pressing portion and a second pressing portion that, when pressed, enable a contact portion/s to engage a function activation element, thereby closing a circuit and activating the associated function/s. Typically, in addition to the pressing portions and the contact portion/s, two resilient members are arranged between the button and the chassis to restore the button after being pushed. Thus, there are quite a few components needed in the button apparatus, and assembly of the button apparatus is complex.

What is needed, therefore, is an improved button apparatus for an electronic device which can overcome the problems described.

SUMMARY

A button apparatus applicable for use in an electronic device includes a button, a cover pivotally engaged with the button, and a chassis secured to the cover. The button includes a body sandwiched between the chassis and the cover, an operating portion extending outwardly from one surface of the body, and two pressing portions extending outwardly from an opposite surface of the body. The two pressing portions are arranged on two opposite sides of the body. The cover defines therein a through hole through which the operating portion of the button extends. The chassis includes a frame, an opening defined in the frame, and an elastic element connected between two opposite sides of the frame. The elastic element includes a first contact portion and a second contact portion. The two pressing portions of the button are positioned at opposite sides of the elastic element of the chassis. When the button is depressed, it moves relative to the cover from an original position to a depressed position, causing one or both of the first and second contact portions of the elastic element to be resiliently distorted and abut one of the two opposite sides of the body. When the button is released, the elastic element restores the button to the original position.

Other advantages and novel features will become more apparent from the following detailed description of embodiments when taken in conjunction with the accompanying drawings.

DETAILED DESCRIPTION

Figure 1:
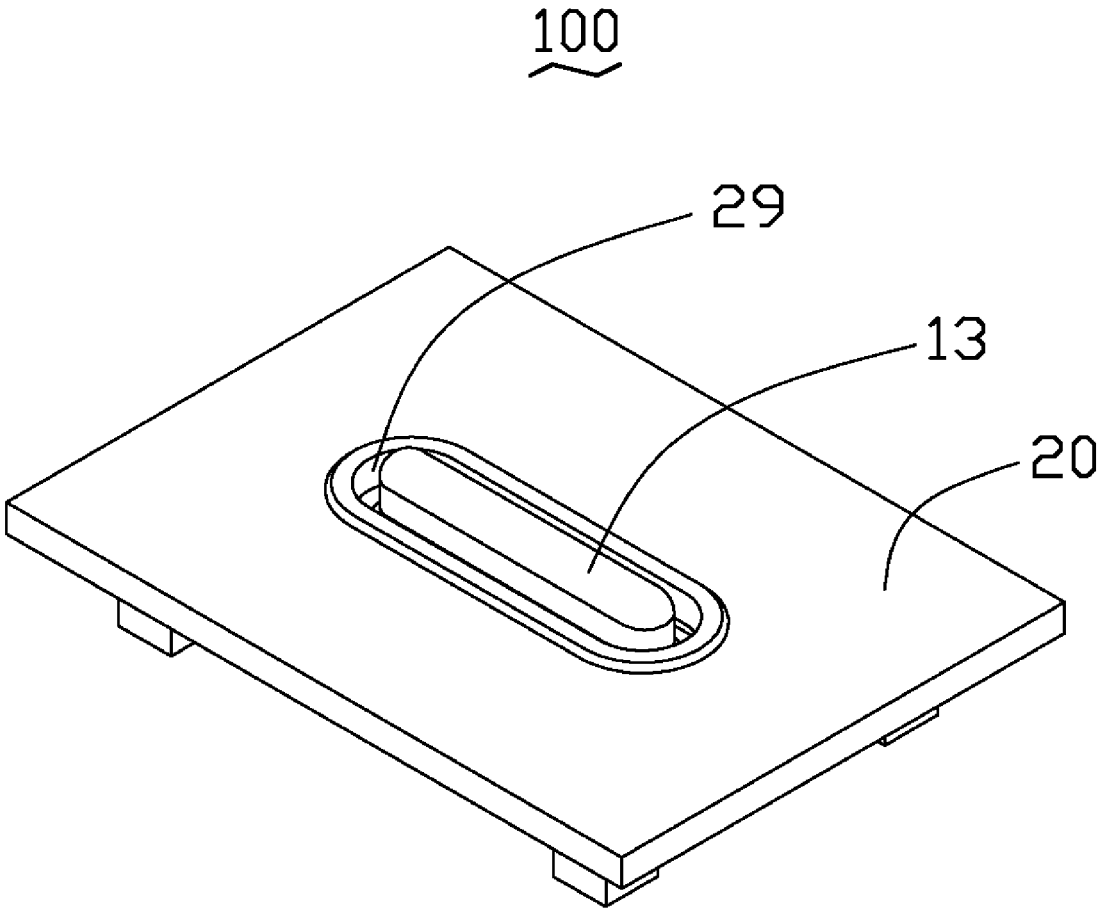
FIG. 1 is an isometric, assembled view of a button apparatus in accordance with a preferred embodiment of the present invention.
Figure 2:
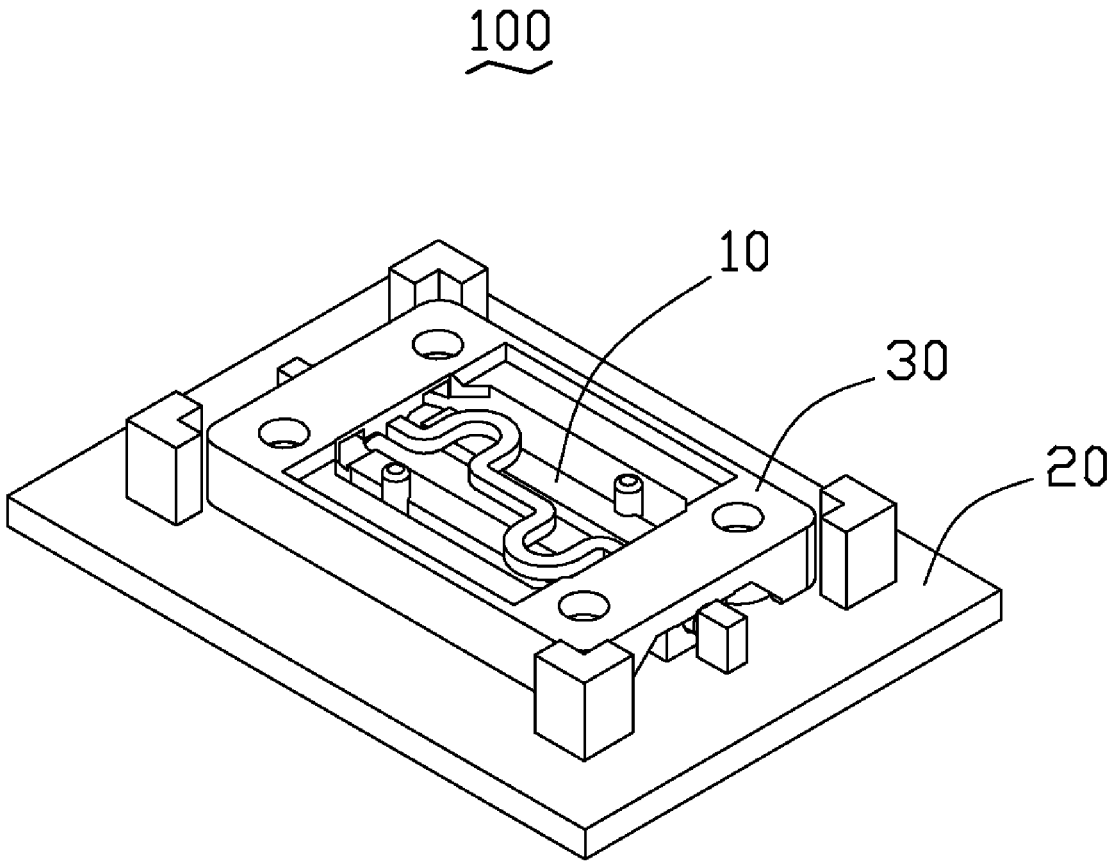
FIG. 2 is an assembled view of the button apparatus of FIG. 1, viewed from another aspect.

FIGS. 1-2 show a button apparatus 100 in accordance with an exemplary embodiment of the present invention. The button apparatus 100 may for example be used in an electronic device such as a digital camera (not shown) for activating functions of the digital camera. The button apparatus 100 includes a cover 20, a chassis 30 secured to the cover 20, and a button 10 arranged between the cover 20 and the chassis 30.

Figure 3:
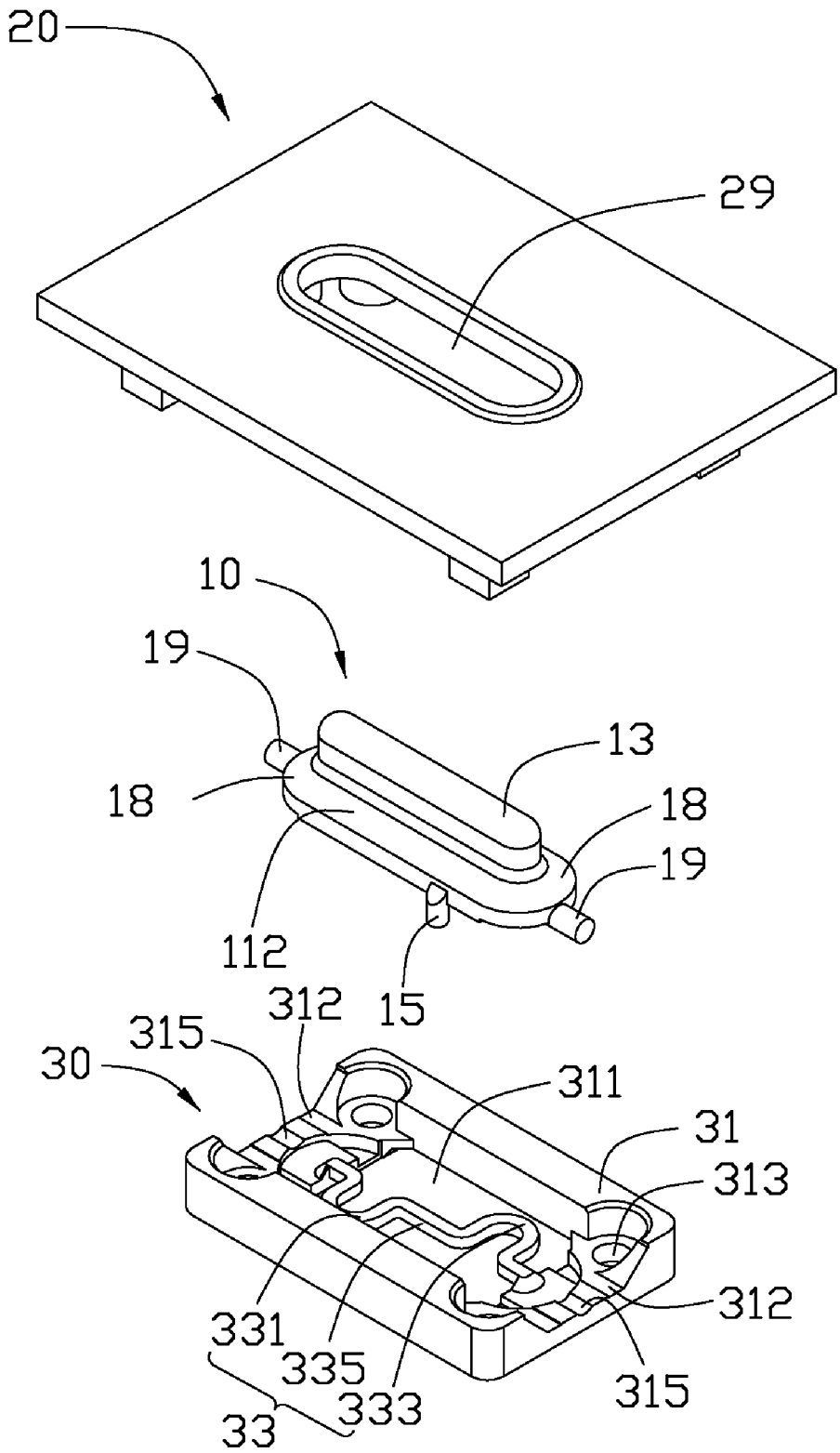
FIG. 3 is an isometric, exploded view of the button apparatus in FIG. 1.
Figure 4:
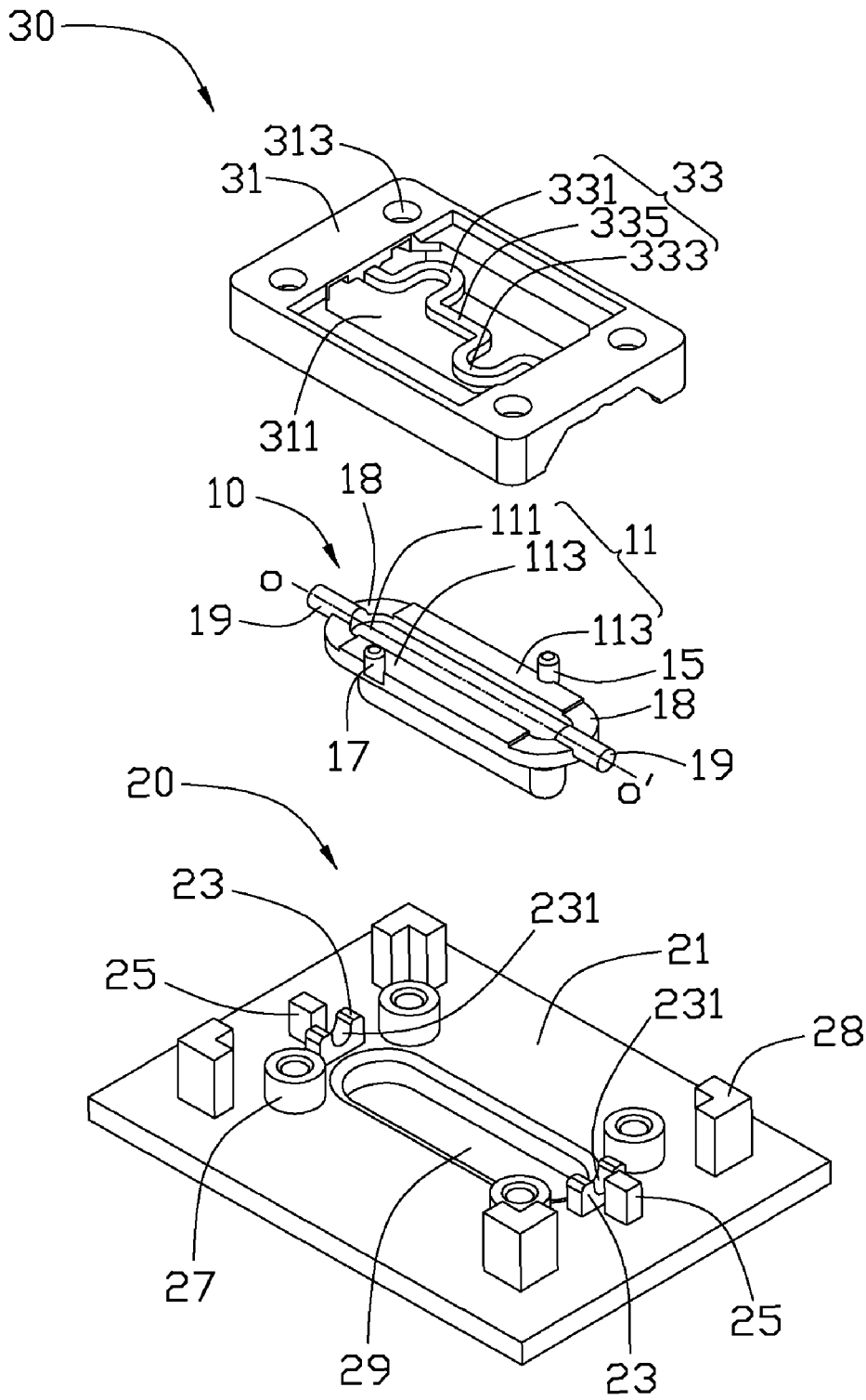
FIG. 4 is an isometric, exploded view of the button apparatus in FIG. 2.

As shown in FIGS. 3-4, the button 10 includes a body 11, an operating portion 13, two pressing portions 15, 17 (i.e. first pressing portion 15 and second pressing portion 17), and two coaxial pivots 19. The body 11 is hollow, with a substantially elongated rectangular configuration in profile and two arc-shaped opposite ends 18. The two pivots 19 extend outwardly along a central axis O-O' of the body 11 from the ends 18. The body 11 includes a curved (e.g. convex) front surface 112 and a flat rear surface 111 opposite to the curved front surface 112. The operating portion 13 is strip shaped and extends upwardly from an inner circumference of the body 11. The rear surface 111 has two opposite long sides parallel to the long axis O-O' of the body 11. Two flanges 113 (shown in FIG. 4) extend downwardly from the two opposite long sides of the rear surface 111 of the body 11, respectively. The first and second pressing portions 15, 17 extend downwardly from the two opposite long sides of the body 11, respectively, with each adjacent to an end of the body 11. The first and second pressing portions 15, 17 are columnar, and each has a distal end lower than the flange 113.

The cover 20 comprises a part of a shell of the camera and has a substantially rectangular configuration. The cover 20 includes a plate 21 defining a substantially rectangular through hole 29 in a center thereof, accepting extension of the operating portion 13. The through hole 29 is larger than the operating portion 13 and smaller than the body 11. Two fixing seats 23 (seen clearly in FIG. 4) extend downwardly from a rear surface of the plate 21 facing the chassis 30. The two fixing seats 23 are arranged symmetrically at two opposite short sides of the through holes 29. The two fixing seats 23 each define a first curved groove 231 at a free end thereof, receiving the pivots 19 of the button 10 therein. The cover 20 further includes two barriers 25 and four positioning blocks 28 extending downwardly from the rear surface of the plate 21. The two barriers 25 are arranged at external sides of and adjacent to the two fixing seats 23, respectively. The four positioning blocks 28 are arranged around the through hole 29, receiving the chassis 30 therein. A plurality of mounting posts 27 integrally extend from the rear side of the plate 21 adjacent to the four positioning blocks 28 respectively to secure the chassis 30 to the cover 20.

The chassis 30 is made of plastic and secured on the rear side of the cover 10. The chassis 30 includes a substantially rectangular frame 31. A substantially rectangular opening 311 is defined in a center of the frame 31. The frame 31 includes two opposite long sides corresponding to the two long sides of the body 11 and two opposite short sides corresponding to the two ends of the body 11. Each of the two short sides of the frame 31 is hollowed inwardly from a top surface thereof, forming a concave 312 at an upper portion thereof. A second curved groove 315 is defined in each concave 312 of the frame 31 corresponding to the first curved groove 231 of each fixing seat 23. When the chassis 30 is secured to the cover 20, each of the second curved grooves 315 of the frame 31 and the corresponding first curved grooves 231 of the two fixing seats 23 of the cover 20 cooperatively form a circular through hole accepting extension of the pivots 19 therethrough. An elastic element 33 is arranged between the two shorter sides of the chassis 30. The elastic element 33 divides the opening 311 of the chassis 30 into two portions. The elastic element 33 includes a U-shaped first contact portion 331, a U-shaped second contact portion 333, and a linear connecting portion 335 interconnecting the first contact portion 331 and the second contact portion 333. The U-shaped first and second contact portions 331, 333 are arranged at opposite sides of the linear connecting portion 335, with their open sides facing each other. Alternatively, the first and second contact portions 331, 333 can show other profiles, such as a V- or W-shape. The chassis 30 defines four positioning holes 313 in four corners thereof corresponding to the mounting posts 27 of the cover 20. Fasteners, such as bolts, screws, or rivets, extend through the positioning holes 313 and mounting posts 27 to fix the chassis 30 to the cover 20.

Figure 5:
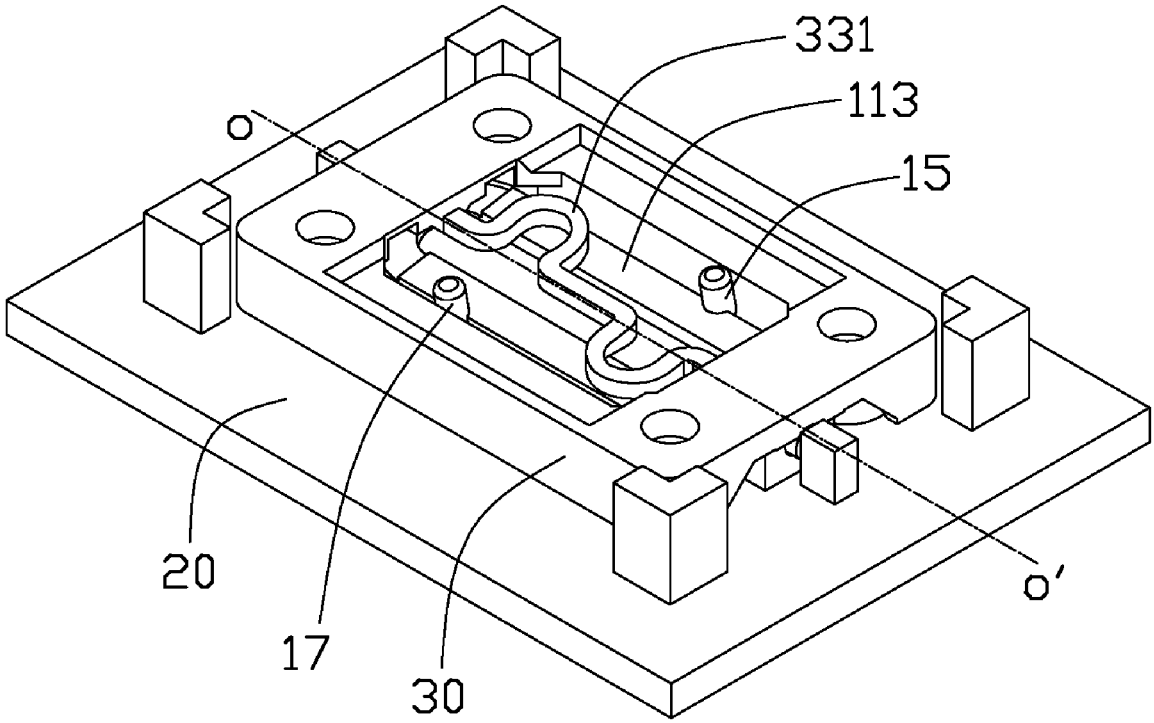
FIG. 5 is similar to FIG. 2, but shows the button apparatus in use with a first contact portion contacting a flange.

Referring to FIGS. 3-5, in assembly, the button 10 is placed on the rear side of the cover 20, and the operating portion 13 of the button 10 passes through the through hole 29 and extends out of the front surface of the cover 20. The two pivots 19 of the button 10 are received in the first curved grooves 231 of the two fixing seats 23 respectively, and the two barriers 25 are positioned adjacent to external ends of the two pivots 19 to prevent the button 10 from moving along the axial direction of the pivots 19. Then the chassis 30 is received in a receiving space formed by the four positioning blocks 28 and the plate 21 of the cover 20. A plurality of fasteners such as bolts are passed through the positioning holes 313 of the chassis 30 to engage the corresponding mounting posts 27 for securing the chassis 30 to the cover 20. The first and second pressing portions 15, 17 overhang the elastic element 33. The body 11 of the button 10 is sandwiched between the cover 20 and the chassis 30. The first and second pressing portions 15, 17 pass through the two portions of the opening 311 respectively and extend out of the chassis 30. The first and second pressing portions 15, 17 are located corresponding to elements of the camera that will activate functions of the camera when contacted.

In operation, the button 10 rotates around the O-O' axis. The first and/or second pressing portions 15, 17 move to contact the function activation elements. As shown in FIG. 5, when the operating portion 13 of the button 10 is depressed, the button 10 rotates. The first pressing portion 15 moves to contact the function activation elements. The first contact portion 331 of the elastic element 33 is pressed by an outer portion of one of the two flanges 113 of the button 10 and resiliently distorted. When the operating portion 13 is released, the first contact portion 331 is restored, thus rotating the button 10 back to the original position.

Because the button 10 of the button apparatus 100 is reset by the elastic element 33 of the chassis 30 to the original position, there in no need for additional resilient elements. Therefore, the button apparatus 100 has the advantage of relatively few components and easy assembly. It is to be understood that the button apparatus 100 can be applied in numerous other electronic devices such as digital video cameras, computers, and so on.

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A button apparatus, comprising:

a button comprising a body, an operating portion extending outwardly from one surface of the body and two pressing portions extending outwardly from an opposite surface of the body, wherein the two pressing portions are arranged on two opposite sides of the body and formed on two diagonally opposite corners of the body respectively;

a cover defining therein a through hole accepting extension of the operating portion; and a chassis secured to the cover to sandwich the body of the button between the chassis and the cover, the chassis comprising a frame, an opening defined in the frame and an elastic element connected between two opposite sides of the frame, the elastic element comprising a first contact portion and a second contact portion, the button pivotally engaged with the cover, and the two pressing portions of the button positioned at two opposite sides of the elastic element of the chassis;

wherein when the button is depressed, it moves relative to the cover from an original position to a depressed position, causing at least one of the first and second contact portions to be resiliently distorted and abut at least one of the two opposite sides of the body, and when the button is released, the elastic element restores the button to the original position.

2. The button apparatus of claim 1, wherein the elastic element further comprises a liner connecting portion connecting the first contact portion with the second contact portion, the first and second contact portions both being curved.

3. The button apparatus of claim 1, wherein the first contact portion is U-shaped, and the second contact portion is an inverted U-shape with an open side thereof facing an open side of the first contact portion.

4. The button apparatus of claim 1, wherein two flanges extend outwardly from the two opposite sides of the body respectively, and the first and second contact portions of the elastic element abut the two flanges respectively when the button is depressed.

5. The button apparatus of claim 1, wherein the button comprises two pivots extending outwardly and symmetrically from two opposite ends thereof respectively, the cover comprising two fixing seats arranged symmetrically at two opposite sides of the through hole thereof, with each defining a curved groove at a free end thereof to receive the pivots of the button therein.

6. The button apparatus of claim 5, wherein the cover further comprises two barriers arranged on external sides of the two fixing seats respectively to prevent the button from moving along an axial direction of the pivots.

7. The button apparatus of claim 5, wherein the body of the button has a substantially rectangular profile, a longitudinal direction of the body is parallel to the axial direction of the pivots, and the two pressing portions of the button are located at two opposite sides of an axis of the pivots.

8. The button apparatus of claim 5, wherein the two fixing seats for receiving two pivots are arranged symmetrically at two opposite sides connected with the elastic element.

9. The button apparatus of claim 1, wherein a size of the through hole of the cover is larger than that of the operating portion and smaller than that of the body.

10. The button apparatus of claim 1, wherein the cover comprises four positioning blocks arranged around the through hole thereof to receive the chassis therein.

11. A button apparatus adapted for use in an electronic device, comprising:

a cover;

a button pivotally engaged with the cover; and comprising a body and two pressing portions, wherein the two pressing portions are arranged on two opposite sides of the body and formed on two diagonally opposite corners of the body respectively; and a chassis secured to the cover, the chassis comprising a frame, an opening defined in the frame, and an elastic element connected between two opposite sides of the frame, the elastic element comprising a first contact portion and a second contact portion, the first and second contact portions attached to two opposition sides of the button respectively;

wherein when the button is depressed, it moves relative to the cover from an original position to a depressed position, causing at least one of the first and second contact portions to be resiliently distorted and abut against at least one of the two opposite sides of the body; and when the button is released, the elastic element restores the button to the original position.

12. The button apparatus of claim 11, wherein the first contact portion has a U-shape, and the second contact portion has an inverted U-shape with an open side thereof facing an open side of the first contact portion.

13. The button apparatus of claim 12, wherein the elastic element further comprises a liner connecting portion connected the first contact portion with the second contact portion.

14. The button apparatus of claim 11, wherein a through hole is defined in the cover, the button comprising an operating portion received in the through hole of the cover and a body sandwiched between the chassis and the cover.

15. The button apparatus of claim 11, wherein the button comprises two coaxial pivots extending outwardly and symmetrically from two opposite ends of the button respectively, the cover comprising two fixing seats each defining a first curved groove at a free end thereof, two second curved grooves defined in the frame and cooperating with the corresponding first curved grooves of the two fixing seats to receive the pivots therein.

16. The button apparatus of claim 15, wherein the cover further comprises two barriers arranged on external sides of the two fixing seats respectively to prevent the button from moving along an axial direction of the coaxial pivots.

17. The button apparatus of claim 15, wherein the two fixing seats for receiving two pivots are arranged symmetrically at two opposite sides connected with the elastic element.

18. The button apparatus of claim 11, wherein two flanges extend outwardly from the two opposite sides of the button respectively, and the first and second contact portions of the elastic element abut outer portions of the two flanges respectively when the button is depressed.

* * * * *